United States Patent [19]

Little

[11] Patent Number: 4,464,231

[45] Date of Patent: Aug. 7, 1984

[54] PROCESS FOR FABRICATING MINIATURE HOLLOW GOLD SPHERES

[75] Inventor: Paul V. Little, Old Field, N.Y.

[73] Assignee: Dover Findings Inc., St. James, N.Y.

[21] Appl. No.: 369,408

[22] Filed: Apr. 19, 1982

Related U.S. Application Data

[63] Continuation-in-part of Ser. No. 199,669, Oct. 22, 1980, abandoned.

[51] Int. Cl.[3] ..... C25D 1/02; C25D 5/50; B22D 29/00

[52] U.S. Cl. ..... 204/9; 164/132; 204/37.1; 427/306; 427/383.1; 427/443.1

[58] Field of Search ..... 427/306, 443.1, 383.1; 29/423; 164/132, 46; 204/9, 37 R

[56] References Cited

U.S. PATENT DOCUMENTS

| | | | |
|---|---|---|---|
| 789,342 | 5/1905 | Voelke . | |
| 3,119,709 | 1/1964 | Atkinson | 117/47 |
| 3,135,044 | 6/1964 | Mote, Jr. et al. | 29/423 |
| 3,314,116 | 4/1967 | Wittmoser et al. . | |
| 3,427,231 | 2/1969 | Schneider et al. | 204/3 |
| 3,464,898 | 9/1969 | Norris | 204/9 |
| 3,470,720 | 10/1969 | Eklund et al. | 72/69 |
| 3,485,643 | 12/1969 | Zeblisky et al. | 427/443.1 |
| 3,496,989 | 2/1970 | Paoli | 164/30 |
| 3,498,365 | 3/1970 | Wittmoser | 164/188 |
| 3,536,368 | 10/1970 | Eklund et al. | 308/188 |
| 3,554,874 | 1/1971 | Mattia | 204/9 |
| 3,654,987 | 4/1972 | Wittmoser et al. | 164/369 |
| 3,766,969 | 10/1973 | Mezby et al. | 164/383 |
| 3,772,750 | 11/1973 | Hauser | 29/148.4 B |
| 3,774,280 | 11/1973 | Eklund et al. | 29/148.4 B |
| 3,861,454 | 1/1975 | Mezey | 164/93 |
| 3,962,497 | 6/1976 | Doty et al. | 427/306 |

*Primary Examiner*—Evan K. Lawrence

*Attorney, Agent, or Firm*—Stanley Ira Laughlin

[57] ABSTRACT

A process for fabricating miniature hollow gold spheres comprising the steps of gold plating copper plated miniature balls having centers employing compressible material, piercing small holes in the balls, extracting the compressible materials from the balls along with the cutouts formed by piercing step, and heat treating said hollow gold spheres.

3 Claims, No Drawings

PROCESS FOR FABRICATING MINIATURE HOLLOW GOLD SPHERES

BACKGROUND OF THE INVENTION

This patent application is a continuation-in-part of Ser. No. 06/199,699, filed Oct. 22, 1980 by applicant and abandoned. The entire disclosure of said Ser. No. 06/199,669 is incorporated by reference in this patent application.

The invention generally relates to the construction and manufacturing of hollow spheres, and, specifically to the fabrication of miniature hollow gold sphere structure used in the assembling of jewelry, such as found in Class 72, subclass 348 and Class 204, subclass 14.

Casting techniques employing foam cellular platic patterns which are used to form the mold that is destroyed by the casting material are taught in U.S. Pat. No. 3,314,116 to Wittmoser et al, U.S. Pat. No. 3,496,989 to Paoli, U.S. Pat. No. 3,498,365 to Wittmoser, U.S. Pat. No. 3,654,987 to Wittmoser et al, U.S. Pat. No. 3,766,969 to Mezby et al and U.S. Pat. No. 3,861,454 to Mezey.

Electroplating and electroforming of gold is well-known, as taught in U.S. Pat. No. 3,427,231 to Schneider et al and U.S. Pat. No. 3,554,874 to Mattia.

Various means for the fabrication of spheres, such as used in making ball bearings, by compressing pieces of tubular pipe are taught in U.S. Pat. Nos. 3,470,720 and 3,774,280 to Eklund et al, and fastening hemispheres is taught in U.S. Pat. No. 3,536,368 and U.S. Pat. No. 3,772,750 to Hauser.

U.S. Pat. No. 3,464,898 to Norris teaches an electroforming process for complex hollow metal articles comprising the steps of forming the mandrel, coating the surface of the mandrel with electrically conductive material, electroplating metal upon the surface of the mandrel and volatizing the plastic mandrell so as to separate it from the electroformed articles.

U.S. Pat. No. 789,342 to Voelke teaches a process of constructing reinforced hollow seamless articles comprising the steps of forming a pattern of fusible material in the form of the article to be made having strengthening pieces imbedded in the pattern, electrodepositing a coating upon the pattern, heating to remove the pattern and forming a continuous metallic layer over the article.

U.S. Pat. No. 3,119,709 to Atkinson teaches the pretreatment of non-metallic surfaces for the electroless deposition of Copper on said surfaces.

It is an object of applicant's invention to provide safe, economical and reliable processes for the fabrication of miniature hollow spherical balls.

It is a further object of applicant's invention to provide a process for producing lightweight miniature gold spheres of intrinsic beauty having hollow centers completely free of the plastic centers.

SUMMARY OF THE INVENTION

Applicant's inventin relates to the process of sensitizing miniature balls made from compressible materials of plastics with activating substances so that a copper coating can be affixed thereto. The copper coated plastic balls are then flashed to stabilize the copper, and then flashed after a coating of silver has been affixed to the copper coating. After the balls are silver plated, they are coated with gold, either by plating or electrodeposition. A very small hole is then pierced through to the compressible plastic material at the center of the miniature ball. The compressible plastic material along with the cutout formed by the piercing step is then extracted through the small hole by thermal and chemical means. Heat treatment of the now hollow gold spheres is performed as the final step to enhance migration of the gold, silver and copper.

DETAILED DESCRIPTION

Applicant's inventive process for fabricating miniature hollow gold spheres or balls comprises the first step of sensitizing spheres or balls of compressible plastic materials including but not limited to polystyrene, polyvinyl chloride and co-polymers, cellulose acetates, ABS, the polycarbonates, or Lucite. Sensitizing the surfaces of these compressible plastic spheres or balls provides for the adherence of copper to the sensitized surfaces and comprises exposing these surfaces to Hydrochloric acid solutions first, and then to a solution of palladium chloride and stannous chloride; the precise formula of said solution being proprietary to TECHNIC, INC., a corporation which supplies said solutions for industrial use. After providing an acceptable surface, the second step naturally is the copper coating, which can be a copper plating such as implemented by a "copper flash". The copper coated or copper plated balls would be silver plated and gold plated, and this third step can be altermately implemented until the desired thickness and alloying is reached; the gold plating being the last plating step. When the plating is completed, a small hole that is substantially 55 thousandths of an inch in diameter is, as the fourth step, pierced into each ball through the layers of copper, silver and gold and into the compressible plastic material in the center of the ball. The fifth step extracts the compressible plastic material by thermal and chemical means; the heating of the ball forcing the compressible plastic material to expand and thereby expel the small cutout resulting from the piercing step, and the chemical solvents evacuating the compressible plastic material in the center of the miniature gold sphere or ball by dissolving said material. For example Polystyrene may be actively attacked by a chlorinated hydrocarbon solvent such as trichloroethylene. The sixth step exposes the miniature spheres or balls to temperatures of approximately 1300 degrees Fahrenheit for approximately 78 hours to enhance migration of the gold, copper and silver. The resulting alloy of which the hollow spheres or balls are made is determined by controlling the alternate silver and gold plating steps. The advantage of the foregoing process is to produce miniature hollow gold spheres which do not have a plastic center.

Although copper coated or plated miniature compressible plastic balls may be obtained through conventional channels of commerce, it is expected that applicant's inventive process comprising only the steps of alternately silver plating and gold plating on the copper coated or copper plated balls, piercing the small hole in the gold plated ball, extracting the compressible plastic material center from the ball by thermal or chemical means and heat treating the miniature hollow gold balls to enhance the migration of the gold copper and silver layers will be within applicant's inventive process.

Although only a limited number of examples of inventive processes have been disclosed, it is expected that applicant's inventive process will be limited only by the scope and breadth of the annexed claims:

I claim:

1. A process for fabricating miniature hollow gold spheres comprising the steps of sensitizing spheres of a compressible plastic material to provide for adherance of copper, coating said compressible plastic material with copper, silver plating said copper coated spheres, gold plating said copper coated, silver plated spheres, piercing a small hole in each of the spheres thereby forming an aperture through said gold, silver and copper to the compressible plastic material at the center of each of the copper coated, silver and gold plated spheres, the small cutouts resulting from said piercing being forced into the interior of the spheres, extracting said small cutouts and the compressible plastic material from the center of said spheres by thermal means comprising heating said spheres to expand the compressible plastic material and thereby expelling said small cutouts, and by chemical means comprising evacuating the compressible plastic material from the center of the miniature spheres by dissolving said material by means of chemical solvents, and heat treating said miniature hollow gold spheres to enhance the migration of said gold, copper and silver.

2. A process as claimed in claim 1 wherein heat treating said miniature hollow gold spheres comprises exposing said spheres to temperatures of approximately 1300 degrees Fahrenheit for approximately 78 hours.

3. A process as claimed in claim 1 wherein said aperture is substantially 55 thousandths of an inch in diameter.

* * * * *